US005788468A

United States Patent [19]

Dewa et al.

[11] Patent Number: 5,788,468

[45] Date of Patent: Aug. 4, 1998

[54] MICROFABRICATED FLUIDIC DEVICES

[75] Inventors: Andrews S. Dewa, Camas; Christophe J. P. Sevrain, Ridgefield, both of Wash.

[73] Assignee: Memstek Products, LLC, Vancouver, Wash.

[21] Appl. No.: 334,264

[22] Filed: Nov. 3, 1994

[51] Int. Cl.[6] ..... F04B 17/03

[52] U.S. Cl. ..... 417/415; 417/417; 417/423.1; 417/410.3

[58] Field of Search ..... 417/355, 356, 417/415, 417, 420, 423.1, 423.7, 410.3, 423.14, 437

[56] References Cited

U.S. PATENT DOCUMENTS

| | | | |
|---|---|---|---|
| 4,528,071 | 7/1985 | Glashauser | 204/11 |
| 4,579,616 | 4/1986 | Windischmann et al. | 156/160 |
| 4,677,042 | 6/1987 | Kato et al. | 430/5 |
| 4,708,919 | 11/1987 | Shimkunas et al. | 430/5 |
| 4,738,010 | 4/1988 | Ehrfeld et al. | 29/149.5 |
| 4,797,211 | 1/1989 | Ehrfeld et al. | 210/321.84 |
| 4,821,997 | 4/1989 | Zdeblick | 251/11 |
| 4,824,073 | 4/1989 | Zdeblick | 251/11 |
| 4,897,360 | 1/1990 | Guckel et al. | 437/7 |
| 4,923,772 | 5/1990 | Kirch et al. | 430/5 |

(List continued on next page.)

FOREIGN PATENT DOCUMENTS

| | | |
|---|---|---|
| 510629 | 10/1992 | European Pat. Off. . |
| 556 622 A1 | 8/1993 | European Pat. Off. . |
| 592094 | 4/1994 | European Pat. Off. . |
| 3292881 | 12/1991 | Japan . |
| 4156508 | 5/1992 | Japan . |
| 4328715 | 11/1992 | Japan . |
| 5142405 | 6/1993 | Japan . |
| 6054555 | 2/1994 | Japan . |

OTHER PUBLICATIONS

Deng et al., "Outer-rotor Polysilicon Wobble Micromotors," *Proceedings IEEE Micro Electro Mechanical Systems An Investigation of Micro Structures, Sensors, Actuators, Machines and Robotic Systems*, Jan. 25–28, 1994, pp. 269–272.

Rapp, LIGA micropump for gases and liquids, Sens Actuators a Phys vol. 40, No. 1, pp. 57–61, 1994.

Rapp, Micropump fabricated with the LIGA process, IEEE Micro Electr Mech Syst Mems, Oct. 1993.

Jerman, "Electrically-Activated, Normally-Closed Diaphragm Valves," *Transducers '91, Digest of Technical Papers*, 1991 International Conference on Solid-State Sensors and Actuators, pp. 1045–1048.

Jerman, "Electrically-Activated, Micromachined Diaphragm Valves, *Technical Digest*, IEEE Solid-State Sensor Workshop, 1990, pp. 65–69.

Long-Sheng Fan et al., "Integrated Movable Micromechanical Structures for Sensors and Actuators," *IEEE Transactions on Electron Devices*, vol. 35, No. 6, Jun. 1988, pp.724–730.

Bryzek et al., "Micromachines on the March," *IEEE Spectrum*, May 1994, pp. 20–31.

Furuhata et al., "Outer Rotor Surface-Micromachines Wobble Micromotor," *IEEE Micro Electro Mechanical Systems*, Feb. 1993, pp. 161–1666.

Folta et al., "Design, Fabrication and Testing of a Miniature Peristaltic Membrane Pump," *IEEE*, 1992, pp. 186–189.

(List continued on next page.)

*Primary Examiner*—Timothy Thorpe
*Assistant Examiner*—Peter G. Korytnyk
*Attorney, Agent, or Firm*—Klarquist Sparkman Campbell Leigh & Whinston, LLP

[57] ABSTRACT

A microfabricated, remotely actuated fluid pump includes a LIGA-fabricated movable member disposed within a cavity. The LIGA-fabricated movable member and the cavity cooperate to (a) define a sufficiently small clearance therebetween to achieve effective pumping action while (b) presenting a sufficiently low-friction fit to enable remote actuation. Such a pump can take the form of a piston pump, a vane pump, a centrifugal pump, a gear pump, etc. Other fluidic devices including flow sensors, piston valves, hydraulic motors, nozzles, and connectors can be fabricated using similar principles.

26 Claims, 10 Drawing Sheets

U.S. PATENT DOCUMENTS

| | | | |
|---|---|---|---|
| 4,943,032 | 7/1990 | Zdeblick | 251/11 |
| 4,943,750 | 7/1990 | Howe et al. | 310/309 |
| 4,966,646 | 10/1990 | Zdeblick | 156/633 |
| 4,996,082 | 2/1991 | Guckel et al. | 427/99 |
| 5,013,693 | 5/1991 | Guckel et al. | 437/248 |
| 5,043,043 | 8/1991 | Howe et al. | 156/645 |
| 5,045,439 | 9/1991 | Maner et al. | 430/394 |
| 5,066,533 | 11/1991 | America et al. | 428/156 |
| 5,069,419 | 12/1991 | Jerman | 251/11 |
| 5,093,594 | 3/1992 | Mehregany | 310/82 |
| 5,096,388 | 3/1992 | Weinberg | 417/322 |
| 5,162,078 | 11/1992 | Bley et al. | 205/75 |
| 5,185,056 | 2/1993 | Fuentes et al. | 156/639 |
| 5,189,777 | 3/1993 | Guckel et al. | 29/424 |
| 5,190,637 | 3/1993 | Guckel | 205/118 |
| 5,206,983 | 5/1993 | Guckel et al. | 29/598 |
| 5,234,571 | 8/1993 | Noeker | 205/70 |
| 5,260,175 | 11/1993 | Kowanz et al. | 430/326 |
| 5,270,125 | 12/1993 | America et al. | 428/698 |
| 5,296,775 | 3/1994 | Cronin et al. | 310/309 |
| 5,298,367 | 3/1994 | Hoessel et al. | 430/326 |
| 5,334,467 | 8/1994 | Cronin et al. | 430/5 |
| 5,342,737 | 8/1994 | Georger, Jr. et al. | 430/324 |
| 5,350,499 | 9/1994 | Shibaike et al. | 204/192.34 |
| 5,362,213 | 11/1994 | Komatsu et al. . | |
| 5,376,506 | 12/1994 | Ehrfeld et al. | 430/321 |
| 5,378,583 | 1/1995 | Guckel et al. | 430/325 |

OTHER PUBLICATIONS

Deng et al., "A Simple Fabrication Process for Side–Drive Micromotors," 7th International Conference on Solid–State Sensors and Actuators, Digest of Technical Papers, Jun. 1993, pp. 756–759.

Zdeblick et al., "A Microminiature Electric–to–Fluidic Valve," *Wescon '87 Proceedings*, p. 24/4/1–2, Nov. 18, 1987.

Van De Pol, et al., "A Thermopneumatic Micropump Based on Micro–Engineering Techniques," *Elsevier Sequoia*, Printed in The Netherlands, 1990, pp. 198–202.

MICROFABRICATED FLUIDIC DEVICES

FIELD OF THE INVENTION

This invention pertains generally to microfabricated fluidic devices (e.g. vane pumps, centrifugal pumps, gear pumps, flow sensors, piston pumps, piston valves, nozzles, connectors, etc.), and methods of their fabrication.

BACKGROUND AND SUMMARY OF THE INVENTION

Since their advent, micromechanical devices have been the subject of extensive investigation. (See, e.g., Stix, "Micron Machinations," *Scientific American*, November, 1992:106–117. "From Microchips to MEMS," *Microlithography World*, Spring 1994, pp. 15–20.) In view the fascinatingly small scale and extreme precision of these devices, substantial interest has arisen in their possible applications, including use as pumps. Unfortunately, applying pump-design principles to machinery having the dimensional scale of micro mechanical devices poses substantial problems, such as overcoming the effects of viscous drag and friction on movement of dynamic members, achieving sufficient minimal clearances between dynamic members and the internal walls of pump cavities, and sealing pump cavities from the external environment.

Work to date on microelectronic pumps has been focused on various types of diaphragm pumps. The main reasons are because diaphragm pumps can be made using bulk silicon micromachining; i.e., certain diaphragm pump designs are readily extrapolated from various microelectronic pressure transducer technology. Also, diaphragm pumps usually do not require any dynamic seals.

Much work has been done in the application of microfabrication techniques to motors (resulting in so-called "micromotors"). However, adapting micromotors for pumping applications presents many new technological challenges that generally defy conventional solutions. Work to date with micromotors has been performed by persons who were mainly concerned with simply getting the rotors to turn. With the exception of certain diaphragm pump embodiments, the known prior art has not revealed a successful utilization of micromotors or other micromachinery devices for pumping applications.

In accordance with a preferred embodiment of the present invention, the above-mentioned and other problems that have rendered fluidic devices unsuitable for microfabrication have been overcome, enabling—for the first time—the realization of a wide variety of practical micromachined fluidic devices.

The need for such devices enabled by the present invention is long-felt. The biomedical field is but one example.

Representative biomedical applications of micromachined pumps include, but are not limited to:

(a) implantable devices for actively infusing a drug or agent from a reservoir into a patient's body;

(b) withdrawal of microscopic amounts of fluid from a subject's body for analysis;

(c) microchemical instrumentation that can be used in vivo or in vitro, such as instrumentation utilizing microsensors; and (d) sequence analysis and/or synthesis of polypeptides or nucleic acids.

There is also great demand for micromachined fluidic devices in other fields—a demand that is finally met by devices according to the present invention.

The foregoing and additional features and advantages of the present invention will be more readily apparent from the following detailed description, which proceeds with reference to the accompanying drawings.

DETAILED DESCRIPTION

Figure 1:
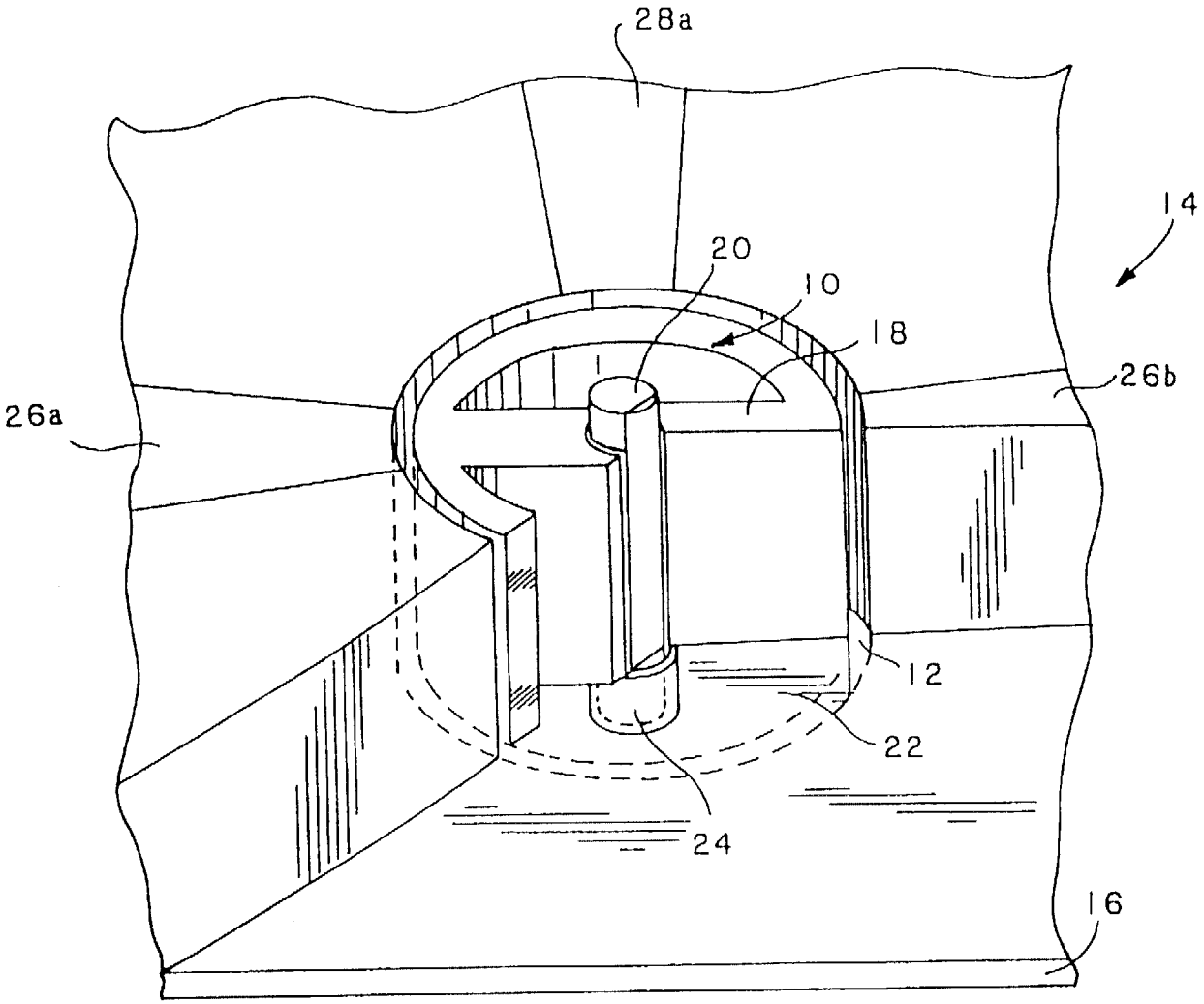
FIG. 1 is a perspective view of a representative embodiment of a rotor, that can be adapted for use as a pump rotor in a miniature pump according to the present invention, actuated by stator pole pieces provided in the pump body.

The present invention is illustrated with reference to a variety of fluidic devices (i.e. devices useful with liquid or gas), including rotary devices (e.g. vane pumps, centrifugal pumps, gear pumps, flow sensors, etc.) and linear devices (e.g. piston pumps, piston valves, etc.). However, it should be recognized that the invention is not so limited; the principles thereof can be applied to virtually any other fluidic device or component.

In the following discussion, reference is sometimes made to fluidic devices being "active" or "passive." An "active" device is one in which a dynamic member(s) causes fluid to pass from an inlet to an outlet, typically requiring input of energy (such as via an actuator). Active devices include, but are not limited to miniature pumps and valves.

A "passive" device is one in which a dynamic member(s) moves in response to passage of fluid through the cavity. Passive devices include, but are not limited to, flow sensors and hydraulic motors.

Devices according to a preferred embodiment of the invention are fabricated, in part, using a technique called LIGA ("Lithographie, Galvanoformung, Abformung"). This technique has been known for at least eight years (see, e.g. Becker et al., "Fabrication of Microstructures With High Aspect Ratios and Great Structural Heights by Synchrotron Radiation Lithography, Galvanoformung, and Plastic Moulding (LIGA Process)," *Microelectronic Engineering*4:35–56 (1986)). However, despite the widespread recognition of LIGA techniques, and the long-felt, unmet need for micro-miniature fluidic devices, others working in this field have failed to successfully implement fluidic devices other than simple diaphragm pumps.

LIGA

Before proceeding further, LIGA technology is briefly reviewed. Additional details can be obtained from the above-cited Becker article, and from U.S. Pat. Nos. 5,190,637, 5,206,983 to Guckel et al (incorporated-herein by reference).

LIGA exploits deep X-ray lithography to create structures characterized by very steep walls and very tight tolerances. Dimensionally, such structures can range from a few micrometers in size up to about 5 centimeters. In the preferred embodiments of the present invention, the LIGA-fabricated structures generally have a thickness of at least 50 micrometers. The steepness of the walls can be measured in terms of their slope, i.e. the change in vertical height of a structure over a horizontal distance. LIGA devices typically have a slope in excess of 500 (i.e. a wall may rise 50 microns in the span of a 0.1 micron horizontal distance). In some LIGA processes, a slope of 1000 or more can be obtained.

LIGA techniques also provide great flexibility in choice of materials, such as photoresist, plated metals (e.g. noble, magnetic, non-magnetic), and molded materials (e.g. plastics, ceramics).

X-ray lithography is well suited for high precision micromachining because x-ray photons have shorter wavelengths and typically higher energies than optical photons. The shorter wavelengths of x-ray photons substantially reduces diffraction and other undesirable optical effects.

X-ray photons are preferably generated using a synchrotron or analogous device, which yields x-ray photons at high flux densities (several watts/cm$^2$) with excellent collimation. As a result of their high energy, these x-rays are capable of penetrating thick (e.g., hundreds of micrometers) layers of polymeric photoresist. Conventional methods employing visible or U.V. light, in contrast, offer much more limited penetration into photoresists. It is due to their excellent collimation that x-ray photons penetrate thick photoresists with extremely low horizontal runout (less than 0.1 μm per 100 μm thickness), thereby producing the substantially vertical walls for which LIGA structures are well known. ("Runout" may be considered the reciprocal of slope.)

Microstructures manufactured using LIGA are produced on a suitable rigid substrate that is usually in wafer form ("wafer" as used herein generally denotes the substrate and any layers previously applied thereto, but is not intended to be specifically limited to wafer-shaped substrates). Since LIGA processes can be performed at low temperatures (e.g., less than about 200° C.), a number of different substrates can be used without degradation or destruction of the substrate. Candidate substrates include, but are not limited to: silicon, ceramic, gallium arsenide, glass and other vitreous materials, germanium, organic polymeric materials, and metals.

With certain substrates, such as semiconductor or non-metallic substrates, a plating base of a material such as chromium or titanium, is first applied to the substrate at the beginning of the LIGA process. Metal substrates may not require a plating base. The plating base facilitates adhesion of a subsequent metal layer applied to the wafer by electroplating whenever the substrate is not metallic or is otherwise incompatible with the subsequently applied metal layer. Typically, the plating base is applied by a sputtering technique, but other techniques may be more suitable for certain applications. If required, the plating base can be overlaid with a thin layer of a metal similar or identical to the metal to be subsequently applied by electroplating.

LIGA methods employ photoresists in order to achieve application of layers of metal or other suitable material to the wafer in a desired pattern. Whereas certain steps may permit use of thin (thicknesses generally several μm) photoresists, other LIGA steps require the use of photoresist applied thickly to the wafer (i.e., photoresist layer thickness up to about 1 cm or more). After application to the wafer, the photoresist is cured if required. The wafer is then exposed to x-rays, preferably high-energy and substantially collimated x-rays, passing through a mask pattern placed over the photoresist. Exposed portions of the photoresist are removed using a suitable developer chemical, thereby leaving voids in the remaining photoresist. A substance such as a metal, metal alloy, ceramic, or polymeric material is then applied to the wafer to fill the voids in the photoresist (metals and metal alloys are usually applied by electroplating methods). Unwanted photoresist can then be removed, followed by another electroplating step if indicated or required. The steps of applying photoresist, regio-selective exposure to x-rays, electroplating, casting, developing, and etching can be performed one or more times in various combinations to ultimately produce the desired structural shape ("superstructure") on the wafer.

Voids in the photoresist left after developing can be completely filled by an electroplatable substance (Galvanoformung), thereby forming either a structural element or a molding master. Molding masters formed using LIGA can be used multiple times to form microminiature parts having a particular desired shape. In addition, because of the extremely small dimensional scale of parts and structures made using LIGA, thousands of LIGA structures, including thousands of identical LIGA structures, can be made on a single wafer.

One or more layers applied to the wafer can be "sacrificial." A sacrificial layer is intended to be partially or completely removed, such as by dissolution or etching, after formation of all or part of the superstructure atop the sacrificial layer, thereby permitting formation of undercuts and other complex voids in the superstructure, as well as removal, if desired, of all or a portion of the superstructure from the substrate. For example, if the superstructure to be formed on the substrate is intended to be removed from the substrate afterward, a plating base can be applied over a sacrificial layer applied directly to the substrate, with the superstructure built up from the plating base.

Use of sacrificial layers permits the formation of suspended or movable superstructures on the substrate. For example, as disclosed in Dr. Guckel's U.S. Pat. No. 5,206,983, LIGA can be used to fabricate a high aspect ratio micromotor wherein the rotor is rotatably mounted on an axle or spindle attached to the substrate or formed on the substrate using LIGA. The rotor can be formed in situ inside a pump cavity formed on a single substrate. Preferably, however, the rotor is formed on a separate substrate over a sacrificial layer, subsequently removed, then rotatably mounted in a pump cavity defined in superstructure formed on a different substrate.

The LIGA photoresist is any material that: (a) can be applied as a layer at the desired thickness to the substrate or to a layer on the substrate, (b) is permeable to x-rays, and (c) after exposure to x-ray photons, forms a substance that is differentially capable of being removed using a suitable developer, depending upon whether or not the substance was actually exposed to x-ray photons.

A particularly suitable photoresist material for LIGA is poly(methyl methacrylate), abbreviated "PMMA", which can be developed (i.e., cured) using an aqueous developing system. Guckel et al., "Deep X-ray and UV Lithographies for Micromechanics," *Technical Digest, Solid State Sensor*

*and Actuator Workshop*, Hilton Head, S.C. Jun. 4–7, 1990, pp. 118–122. PMMA can be applied by in situ casting of liquid PMMA resin on the wafer followed by a curing reaction to cross-link the PMMA resin. Since in situ cross-linking of thick PMMA films can result in the generation of stresses in the PMMA film, which can result in warping and other undesirable consequences, PMMA can be applied directly as a preformed sheet by solvent bonding the sheet to a wafer that had been previously spin-coated, for example, with a single layer of PMMA. (See Guckel patents.)

The maximum permissible thickness of photoresist such as PMMA that can be used is dependent upon the characteristics of the synchrotron or analogous device used to produce the x-ray photons. For example, a 1 GeV machine filtered with 250 μm beryllium has a critical energy of 3000 eV, at which energy the PMMA absorption length is 100 μm; this implies an exposure depth of about 300 μm within a reasonable time. A 2.6 GeV synchrotron having a critical energy of about 20,000 eV when used with a 1 mm beryllium filter has a corresponding PMMA absorption length of about 1 cm. Thus, exposures up to several centimeters in depth in PMMA are feasible. PMMA thicknesses greater than about 1 cm allow the PMMA photoresist to be free-standing, if desired, and permit the manufacture of structures, using LIGA, having thickness dimensions of 1 cm or greater while maintaining submicron tolerances in runout.

Any of various configurations of active fluidic devices in which the dynamic component(s) are rotary-actuated or linear-actuated are encompassed by the present invention. Representative embodiments of miniature pumps, as well as flow sensors and hydraulic motors according to the present invention, which embodiments are not intended to be limiting in any way, are disclosed below.

In part because of the small size of fluidic devices according to the present invention, it is possible to provide multiple such devices (such as thousands of complete miniature pumps) on a single substrate. All the fluidic devices on a single substrate can be either the same or different as requirements dictate. For example, multiple miniature pumps can be provided on a single substrate and used individually for different tasks or used collectively to achieve flowrates that are substantially higher than achievable using a single miniature pump. When used collectively, multiple miniature pumps can be hydraulically connected together in series or parallel, or in any conceivable combination of series and parallel. Fluid conduits interconnecting individual fluidic devices on a substrate can be integral with the devices and formed on the substrate simultaneously with forming the devices themselves.

Actuation of Pump Rotors of Rotary Miniature Pumps

Rotary miniature pumps according to the present invention all have at least one pump rotor that must be "actuated" (i.e., caused to rotate about a fixed axis) in order to derive useful work from the miniature pump. Even though different types of rotary miniature pumps are distinguishable from one another by, inter alia, the different radial profile(s) of the pump rotor(s), virtually all pump rotors requiring actuation can be actuated in substantially the same ways. Thus, it will be understood that the following general discussion is applicable to any of various types of pump rotors.

Direct actuation of the pump rotor is preferably performed by having the pump rotor serve as both a pump rotor and the rotor of a micromotor employed to drive the miniature pump. It is also possible to couple, such as magnetically, the pump rotor to an external prime mover. Both general methods of rotor actuation avoid the need to provide a rotary seal through the pump body.

In instances wherein a pump rotor also serves as a micromotor rotor, the rotor can be actuated either magnetically or electrostatically. An example of magnetic actuation can be found in conventional stepper motors and other variable-reluctance motors. In electrostatic actuation, the force applied to the rotor is proportional to a change in capacitance which is a function of the rotor angle relative to a stationary element on which is imposed an electrostatic charge.

A first embodiment for directly actuating a rotor is shown generally in FIG. 1 (with a portion of the rotor and surrounding superstructure cut away for clarity). A rotor 10 is situated in a cavity 12 defined by the superstructure 14 formed on a substrate 16 using LIGA methods. The rotor 10, shown with a generally cylindrical profile, has a diametrically oriented magnetic portion 18 made of a ferromagnetic material such as nickel or nickel alloy. (More poles, not shown, can also be provided on the rotor if necessary.) The rotor 10 is mounted on a fixed axle 20 defining a rotational axis so as to allow the rotor 10 to rotate about the axis. The cavity 12 has a bottom 22 from which the rotor 10 can be elevated by a sleeve 24 or analogous feature (optional) provided either on the rotor or the bottom 22 to minimize frictional interaction of the rotor 10 with the bottom 22. At least one pair of diametrically opposing stator pole pieces (e.g., **26*a*, 26*b*) is provided adjacent the cavity 12 in a manner allowing magnetic interaction of the rotor 10 with the pole pieces. (Four stator pole pieces 26*a*, 26*b*, 28*a*, 28*b* are provided in the embodiment of FIG. 1, each oriented at a right angle to adjacent stator pole pieces, but one (28*b*) has been cut away to reveal other detail.) It will be immediately recognized that energization of an opposing pair of pole pieces in a manner generating a magnetic field therebetween will urge an orientation of the rotor 10 relative to the energized pole pieces. Thus, sequential energization of the pole pieces will cause corresponding rotation of the rotor 10** about its axis.

In any embodiment as described above in which the rotor is magnetic and is intended to contact the fluid to be pumped, the rotor can be made of a magnetic material that is chemically compatible with the fluid to be pumped. Alternatively, the rotor can have an external "skin" of a material that is inert to the fluid to be pumped. Such a skin can be of, for example, an inert metal (such as gold) applied to the rotor by, e.g., electroplating, evaporative sputtering, or CVD; a metal oxide, nitride or other inert metal compound; a glass material; or an inert organic polymer. Alternately, a surface modification technique, such as ion nitridization, can be used to change the properties of the rotor without changing its thickness.

Energization of the stator pole pieces **26*a*, 26*b*, 28*a*, 28*b*** can be performed in a variety of ways. For example, the stator pole pieces can be magnetically coupled to an external permanent magnet provided beneath the substrate outside the cavity (not shown). Rotation of the magnet imposes a corresponding periodic magnetization of the pole pieces sufficient to cause a corresponding rotation of the rotor (see FIG. 8 of Dr. Guckel's U.S. Pat. No. 5,206,983). It is also possible to use this scheme to effect magnetic coupling directly from the external magnet to the rotor, thereby eliminating the need for a stator (see FIG. 3B).

Alternatively, opposing stator pole pieces can be magnetically energized using a stationary electromagnet, situated outside the cavity in a manner allowing magnetic coupling to the stator pole pieces, that is subjected to two-phase electrical energization (not shown; but see FIG. 11 of U.S. Pat. No. 5,206,983, incorporated herein by reference). In such a scheme, each opposing pair of pole pieces can be energized by a separate electromagnet. This scheme can also be used to effect magnetic coupling directly from the external electromagnet to the rotor, thereby eliminating the need for a stator.

Figure 2A:
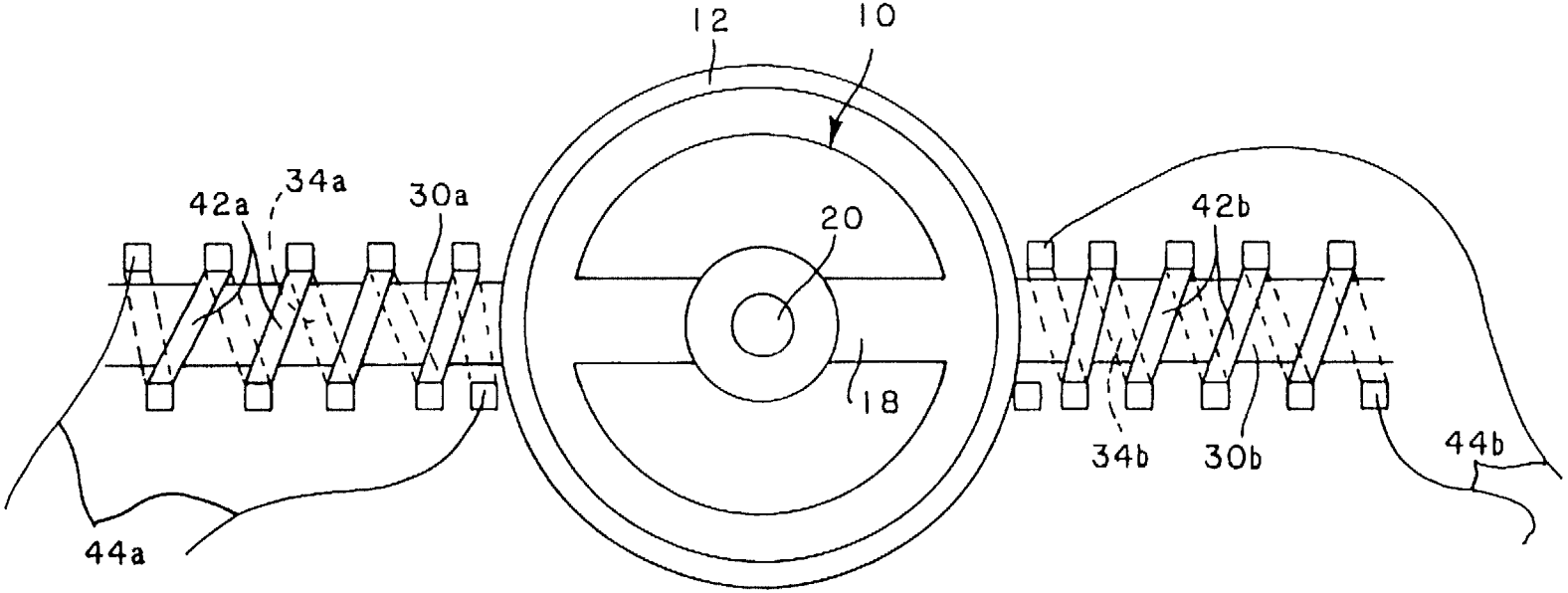
FIGS. 2A–2C are views of magnetic-rotor devices, and associated stator coil arrangements.
Figure 2B:
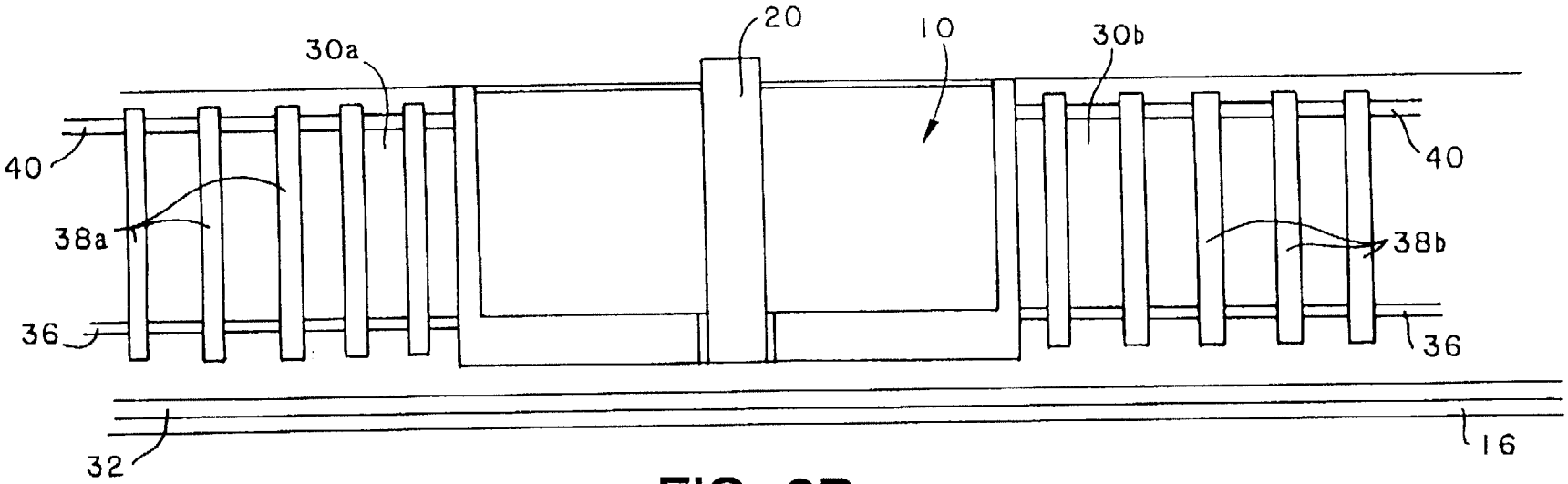

Alternatively, the stator pole pieces can be magnetized by electrically energizing them directly, thereby eliminating the need to magnetically couple them to an outside magnetic field. For example, as shown in FIGS. 2A and 2B, stator pole pieces 30*a*, 30*b* can be formed on the substrate 16 along with electrical "coils" surrounding each pole piece to make each pole piece into an electromagnet, all using LIGA techniques. The pole pieces 30*a*, 30*b* are made of a magnetizable material, such as a nickel-iron alloy, that can be electroplated at a high aspect ratio on the substrate 16. A layer 32 of sputtered nickel is applied to the substrate, which is subsequently patterned using an electrically conductive metal to form coil "cross unders" 34*a*, 34*b* (i.e., sections of electrically conductive coils that will underlie the pole pieces 30*a*, 30*b*, respectively, yet to be formed on the substrate). The "cross unders" are covered with a dielectric film 36 deposited using, for example, a chemical vapor deposition technique. The termini of the "cross unders" are left uncoated with the dielectric (or can be etched off). LIGA is then employed to form the pole pieces 30*a*, 30*b* and the vertical sections 38*a*, 38*b* of the coils surrounding each pole piece. The vertical sections of the coil are plated directly on the uncoated termini of the "cross unders" 34*a*, 34*b* so as to be electrically contiguous with the "cross unders". After application of another patterned dielectric film 40, a subsequent patterned plating of electrically conductive metal atop the pole pieces can be performed to form "cross overs" 42*a*, 42*b* which complete the coils around each pole piece. Alternatively, "cross overs" can be made using small wires (not shown) bonded to the tops of the vertical coil sections 38*a*, 38*b*. Coils surrounding diametrically opposing pole pieces 30*a*, 30*b* can be electrically connected to each other and to a source of electrical current using wires 44*a*, 44*b*. Sequential electrical energization of the coils surrounding diametrically opposed pole pieces produces a "revolving" magnetic flux urging the rotor 10 to rotate about its axis.

Figure 2C:
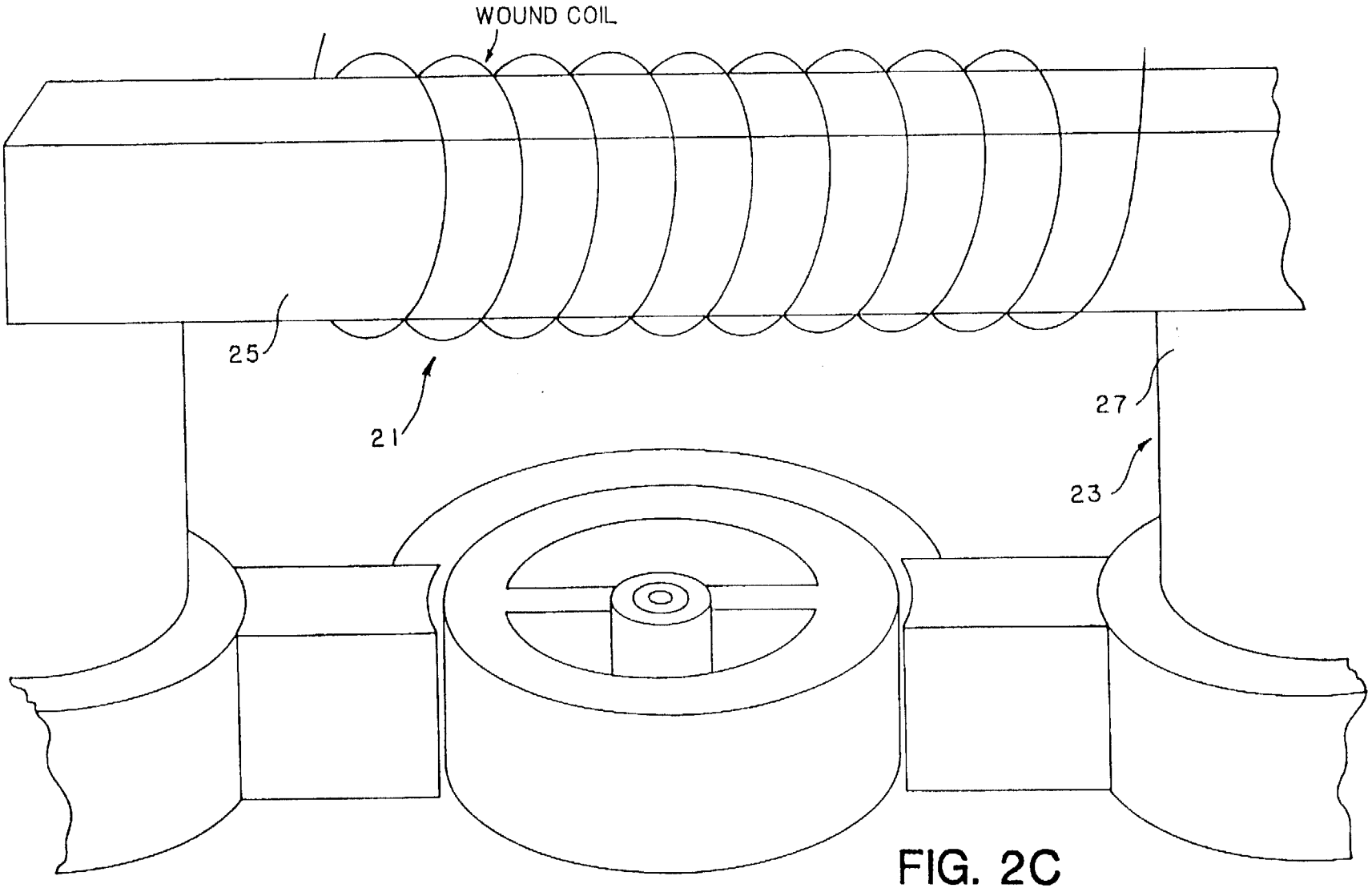

Instead of forming coils by plated conductors and crossovers, a conventional wound coil can be used instead, as shown in FIG. 2C. Here a coil 21 is wound on a structure 23 of LIGA-fabricated parts (e.g. form 25, secured on posts 27) on the wafer. This arrangement allows coils of hundreds of turns, producing a commensurate increase in the magnetic force.

Still further, the rotor can be electrostatically actuated. Electrostatic actuation, according to conventional methods, usually requires that the rotary member be electrically grounded. Stator pole pieces are provided radially around the rotary member as described above. In electrostatic actuation, the pole pieces are electrically charged at an appropriate instant relative to the rotational orientation of the rotor, wherein the resulting force applied to the rotor by the pole pieces changes in proportion to a change in capacitance, which is a function of the angle of the rotary member relative to a particular opposing pair of pole pieces.

In any of the foregoing schemes, the stator can be located either in the same plane as the rotor, as discussed above, or in a separate axially displaced plane. When the stator is located in a separate plane, the rotor is typically axially extended to provide a portion that can interact with the stator.

It is also possible to drive two or more rotors in a pump simultaneously from a single stator by interconnecting the rotors using microminiature gears. Such gears can also be manufactured using LIGA methods. (See. e.g., FIG. 9 of Dr. Guckel's U.S. Pat. No. 5,206,983.)

It will be appreciated that stator pole pieces need not be situated radially relative to the rotor. Rather, in certain embodiments, it may be more advantageous or necessary for the pole pieces to extend in a plane through which passes the axis of the rotor, thereby orienting the magnetic flux lines from the pole pieces to the rotor in a direction substantially parallel to the axis of the rotor. In addition, even if the stator pole pieces are situated radially relative to the rotor, they need not be situated in the same plane as the rotor.

Gear Pump Embodiments

Gear pumps that can be produced using LIGA include external and internal gear types. According to conventional principles, in an external gear pump, the center of rotation of each driving gear is external to the major diameter of the driven gear, and vice versa; and both the driving and driven gears are of the external tooth type. In an internal gear pump, according to conventional principles, the center of rotation of one of the gears is inside the major diameter of the other gear, and at least one of the gears is an internal-tooth type or crown-tooth type.

Figure 3A:
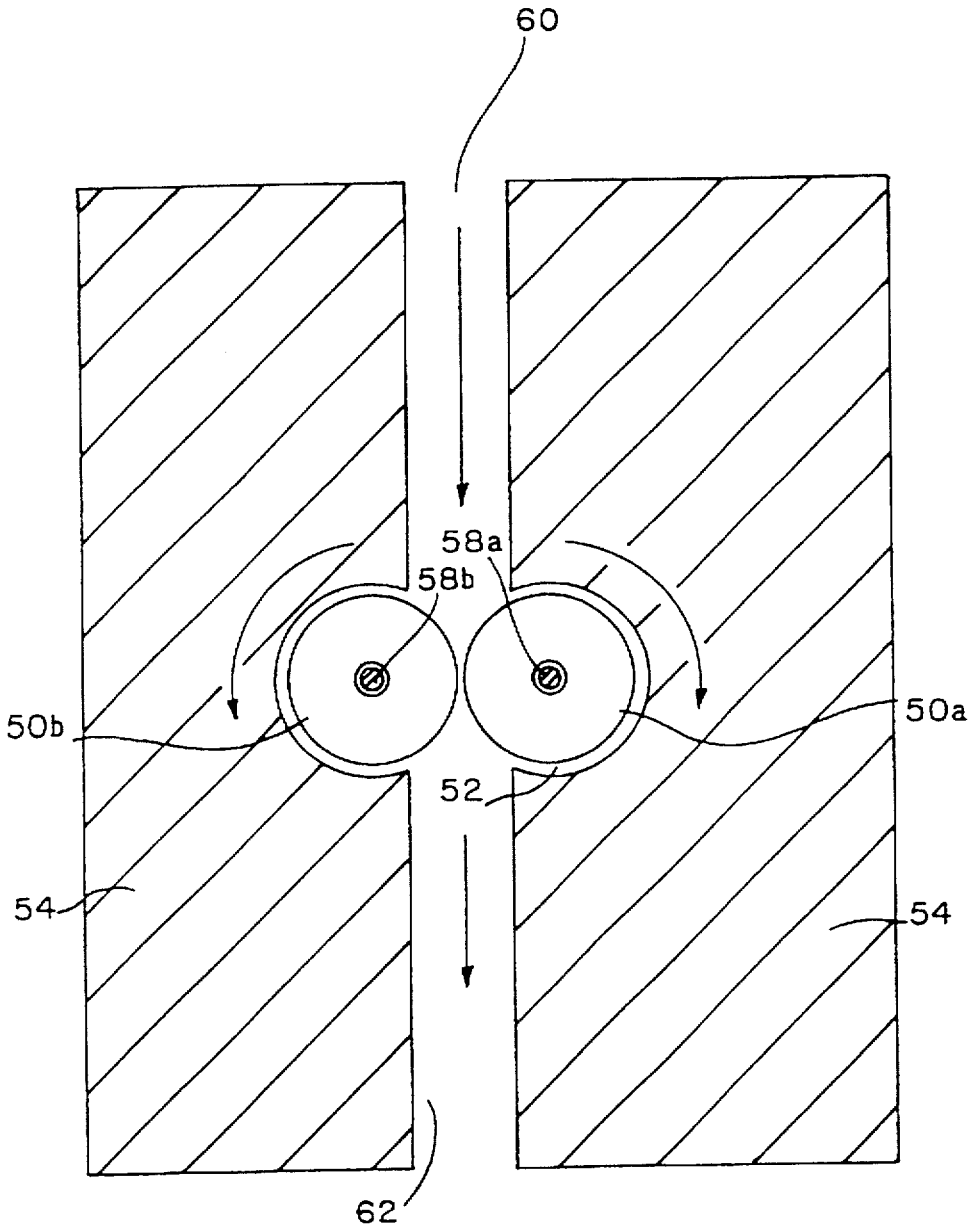
FIGS. 3A and 3B are schematic plan and elevational views, respectively, of a gear pump embodiment according to the present invention.
Figure 3B:
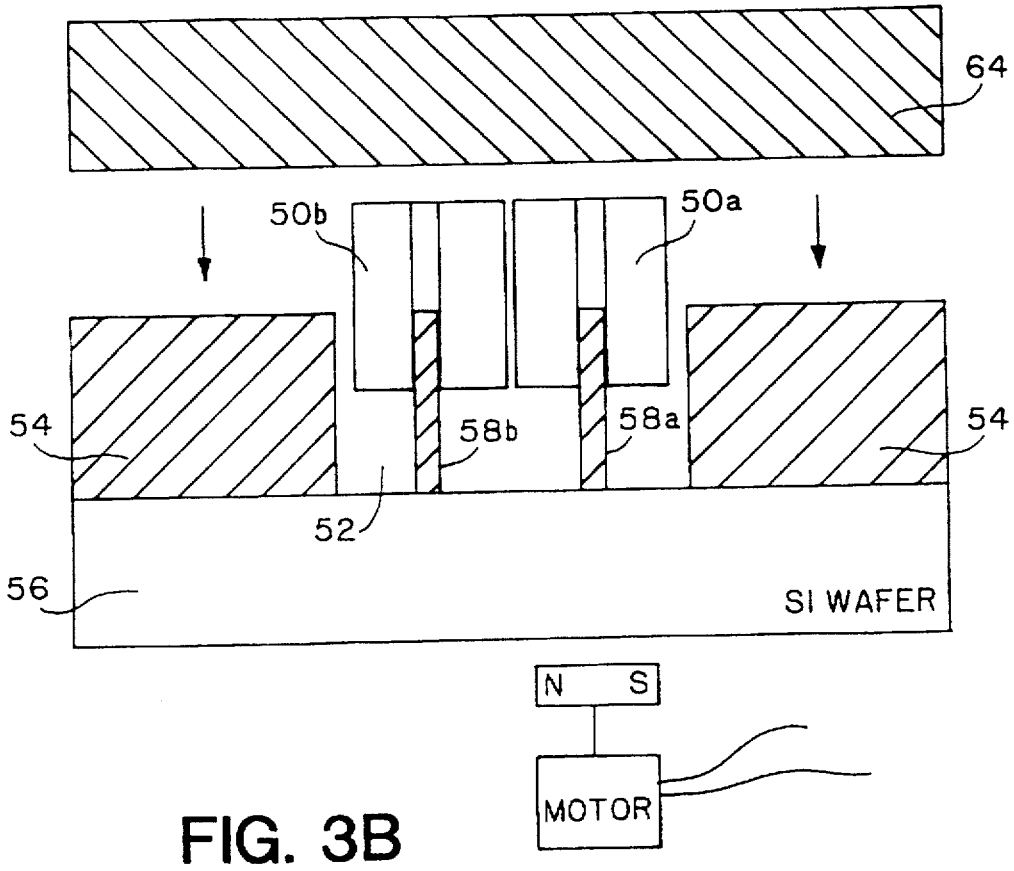

A representative external gear-pump embodiment is shown in FIGS. 3A–3B, which comprises first and second rotary members 50*a*, 50*b*, respectively. The first rotary member 50*a* serves as a first pump gear (radially arranged gear teeth around the circumference are not shown); the second rotary member 50*b* serves as a second pump gear (again, gear teeth are not shown) enmeshed with the first pump gear. Reflective of their function, the first and second rotary members 50*a*, 50*b*, respectively, are termed the driving and driven gears, respectively.

The meshed driving and driven gears 50*a*, 50*b* are situated in a pump cavity 52 defined by a pump body 54 applied in one or more layers to a substrate 56 via a LIGA process. The pump body 54 can be formed of any of various materials such as, but not limited to, copper or PMMA. Because the pump body 54 is normally left attached to the substrate 56, the LIGA process used to form the pump body 54 on the substrate 56 is termed an "anchored" LIGA process.

The driving gear 50*a* and the driven gear 50*b* are rotatable about respective axes such as by mounting the gears on respective axles 58*a*, 58*b* or pins which can be integral with the substrate 56 or a with layer on the substrate. The cavity 52 circumferentially conforms to the driving and driven gears with sufficient radial clearance to permit rotation of the driving and driven gears 50*a*, 50*b*, in the cavity.

The driving and driven gears 50*a*, 50*b* can be formed in situ using the LIGA sacrificial layer technique (see, U.S. Pat. No. 5,206,983). However, forming the gears in situ can result in excessive clearance between each gear and the walls of the cavity as well as excessive clearance between the teeth of the driving gear and the teeth of the driven gear. Hence, the driving and driven gears are preferably constructed separately on another substrate (using the "sacrificial" LIGA technique), then assembled on the respective axles 58*a*, 58*b*. This ensures the closest possible tolerances between the driving and driven gears and the closest possible radial tolerances between the gears and the walls of the pump cavity 52.

The driven gear 50*b* can be made of any of various materials such as, but not limited to, PMMA or copper. Because the driving gear 50*a* preferably magnetically interacts with a separate rotor or other rotary actuator located outside the pump cavity 52, the driving gear 50*a* is made of a magnetic material, such as, but not limited to, permalloy or nickel, or at least includes a magnetic dipole therein made of a magnetic material or a permanent magnetic material.

Figure 4:
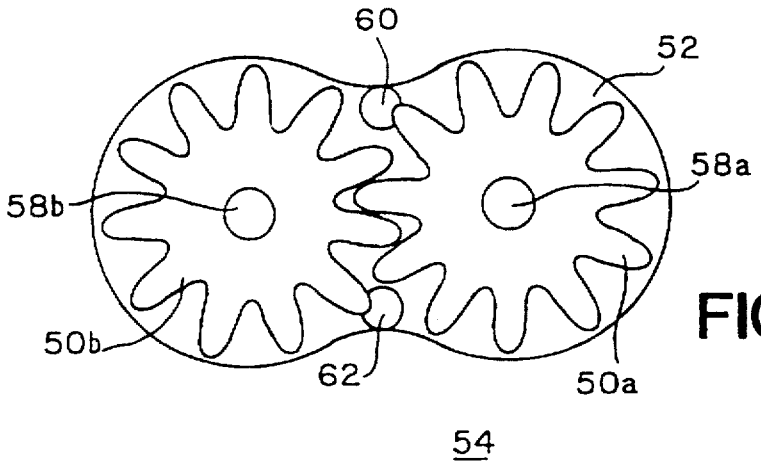
FIG. 4 is a plan view of intermeshed driving and driven gears of a gear pump according to the present invention.

The driving and driven gears preferably have intermeshing teeth having an involute profile (FIG. 4). However, other tooth profiles may be more suitable for certain pumping applications. Tooth width should be minimally about 20 μm to ensure adequate tooth strength. The diameter of gears made using the LIGA process would typically range from 100 μm to about 1 mm, and the height of the gears would typically range from about 100 μm to about 1 cm. Also, space permitting, the driving gear can be meshed with more than one driven gear.

The pump cavity 52 must be provided with a means for conducting fluid into the pump cavity upstream of the meshed gears and a means for conducting fluid from the pump cavity downstream of the meshed gears. Normally, these criteria are met by providing the pump cavity 52 with an inlet 60 and an outlet 62. As shown in FIG. 3A, the inlet 60 and outlet 62 can be configured as separate flow channels formed in the pump body 54 using LIGA methods. See, e.g., U.S. Pat. No. 5,190,637 to Guckel. The inlet and outlet channels 60, 62, respectively, can be made of the same material as the pump body 54. The channels can be covered using a cover plate 64 attached to the pump body 54 (FIG. 3B). Alternatively, use of sacrificial-layer LIGA techniques permits the formation of covered channels without having to use a cover plate. According to the particular pattern on the photomask, inlet and outlet channels can be made extending away from the pump cavity, as shown in FIG. 3A. Alternatively, anisotropic apertures can be formed in the pump body, cover plate, or in the underlying substrate, again using LIGA methods, to serve as inlet and outlet ports for the pump cavity 52 (see FIG. 4). Fluid conduits can be attached to the inlet and outlet channels using conventional methods, if required.

Gears made using LIGA methods have sufficiently high aspect ratios to be useful in gear pumps according to the present invention. Such gear pumps are capable of delivering flow rates of about 1 μL/min to about 5 mL/min. Also, gears individually produced apart from the pump body can have exceptionally tight tolerances of 0.1 μm or less, which are much tighter than achievable by other known methods. Such tight tolerances make possible the manufacture of miniature pumps that are substantially "positive displacement."

It is important that the gears not encounter excessive rotational friction during operation. Examples of ways in which friction can be reduced are use of fluted axles for mounting the gears and ensuring that the inside walls of the pump cavity are smooth. Also, any portion of the gears that actually contact an interior surface of the pump cavity should be configured so as to contact the surface with as low a friction as possible. For example, a gear can be provided with an integral collar or the like to minimize the contact area of any surface of the gear that contacts a cavity wall.

Rotary Piston Pump Embodiments

Many of the principles by which rotary gear pumps are made using LIGA can also be applied to making any of various rotary piston pump embodiments.

Figure 5:
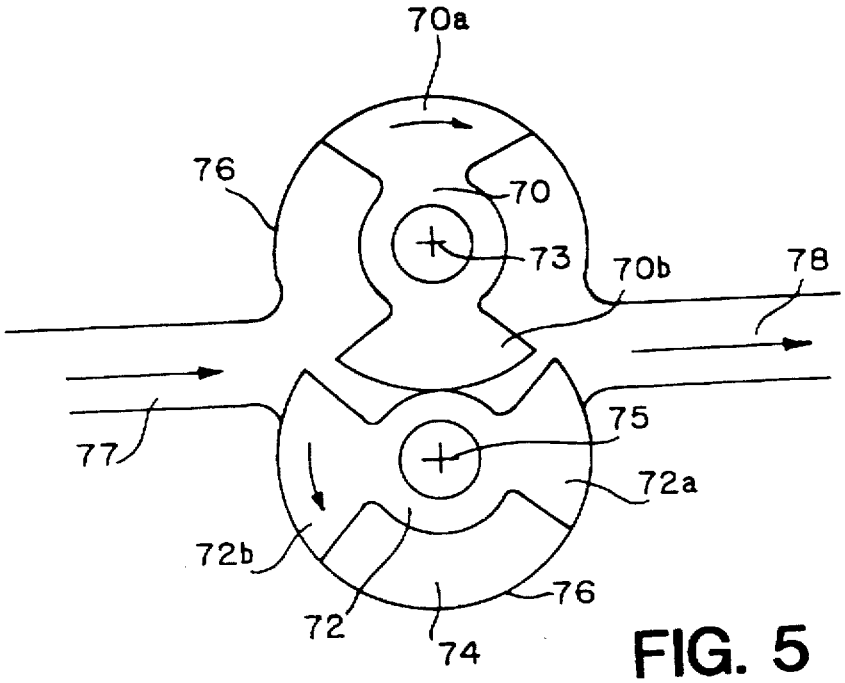
FIG. 5 is a schematic plan view of a representative rotary piston pump embodiment according to the present invention.

In a rotary piston pump embodiment according to the present invention, piston-like rotary elements (rotors) are provided, using LIGA technology, in a pump cavity. In an external circumferential piston pump as shown in FIG. 5, at least two rotors 70, 72 are used, each typically having two lobes 70*a*, 70*b*, 72*a*, 72*b* with a radial surface and each rotatable about a respective axis 73, 75. The rotors are driven simultaneously; thus, it is possible to use a gear (not shown), but see FIG. 10 of U.S. Pat. No. 5,206,983) to rotationally link the rotors 70, 72 together and drive them simultaneously using a single stator or other rotary actuator as described above. The rotors 70, 72 are disposed in the pump cavity 74 which has walls 76 radially conforming to the radial surfaces of the lobes on the rotors. The lobes 70*a*, 70*b*, 72*a*, 72*b* on the rotors 70, 72 do not touch each other during operation. The clearance between the radial surfaces of the lobes and the radial walls of the pump cavity is kept as small as possible to ensure positive displacement of pumped fluid as the rotors rotate, while avoiding excessive friction. The pump cavity 74 is provided with an inlet 77 and an outlet 78.

As with gear pumps, "internal" embodiments of rotary piston pumps are also possible, in which the center of rotation of one of the rotors is inside the major diameter of the other rotor.

Rotary Lobe Pump Embodiments

Lobe pumps share a number of similarities with other rotary pumps; thus, LIGA technology can be used to make rotary lobe pump embodiments according to the present invention in a manner similar to that described above with respect to, for example, gear pumps. Actuation of the rotors of rotary lobe pump embodiments can be effected in the same manner as described above with respect to gear pumps and rotary piston pumps.

Figure 6:
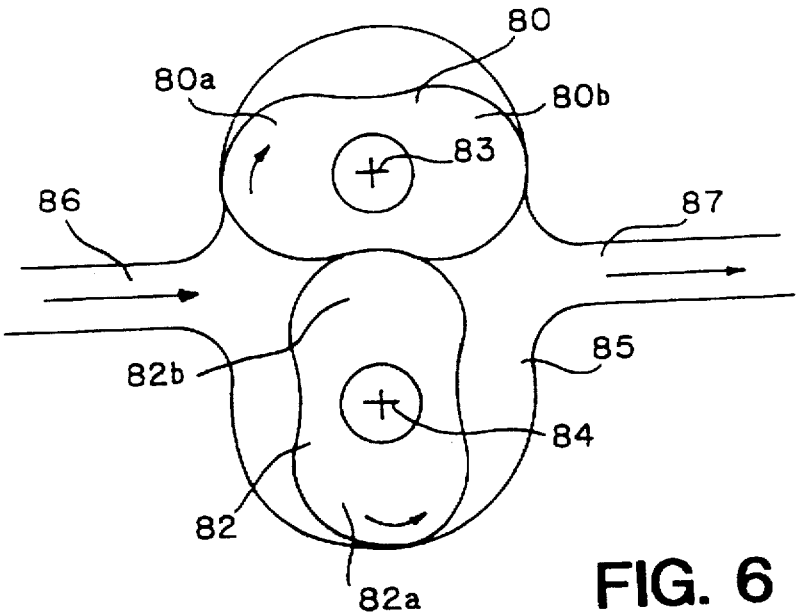
FIG. 6 is a schematic plan view of a representative rotary lobe pump embodiment according to the present invention.

As shown in FIG. 6, an "external" lobe pump has rotors 80, 82 with rounded lobes 80*a*, 80*b*, 82*a*, 82*b* that interdigitate with and remain in contact with each other as the rotors 80, 82 rotate about respective axes 83, 84. Also, neither rotor drives the other; rather, the rotors are simultaneously driven. Each rotor can have one or multiple lobes, but three lobes per rotor is usually the maximum practical number of lobes.

According to the present invention, the rotors 80, 82 can be made in situ in a pump cavity 85 and on a substrate using LIGA technology. Alternatively, to ensure the tightest possible tolerances, the rotors 80, 82 can be made separately from the pump cavity 85 using sacrificial layer LIGA methods, then assembled into the pump cavity 85. The pump cavity is provided with an inlet 86 and an outlet 87.

"Internal" lobe pump embodiments are also possible, wherein a single rotor is provided having a lobelike peripheral shape that interdigitates with lobes provided in the radial walls of a pump cavity. The rotor is rotated in a manner providing a combination of rotation and gyration of the rotor center in the pump cavity in such a way that the rotor always radially touches the lobe-shaped contours of the pump cavity, thereby providing positive displacement pumping action.

Rotary Centrifugal Pump Embodiments

Figure 7:
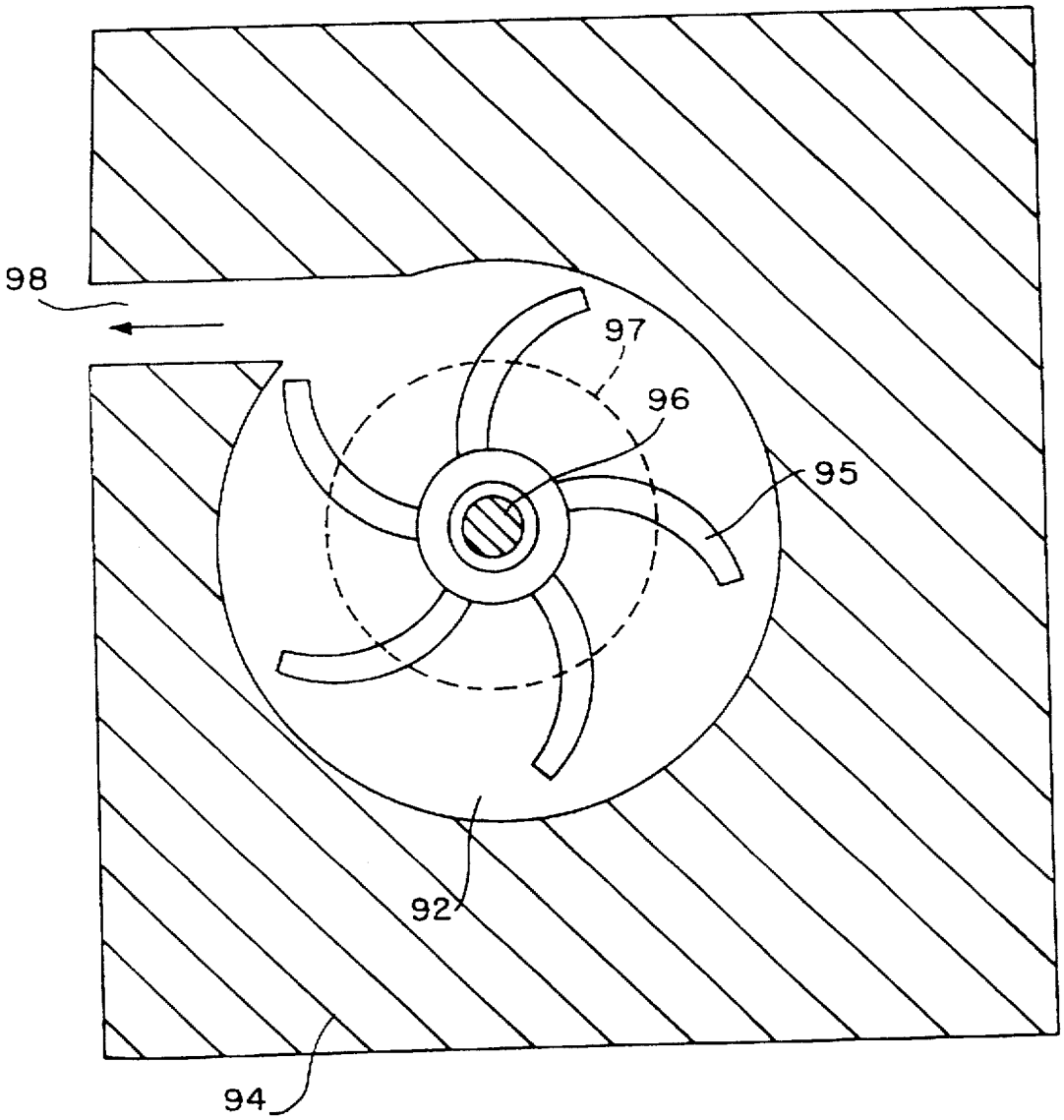
FIG. 7 is a schematic plan view of a representative rotary centrifugal pump embodiment according to the present invention.

A representative embodiment of a centrifugal miniature pump according to the present invention is shown in FIG. 7. The centrifugal pump comprises a pump cavity 92 defined by a pump body 94 that is superstructured on a rigid substrate. The pump body 94 can be made from a suitable metal electroplated onto the substrate or from a polymeric or other castable material adhered to the substrate using LIGA methods. A vaned rotor 95 is mounted in the cavity 92 on a fixed axle 96, and can be actuated by a micromotor rotor (not shown) coaxially affixed to the pump rotor 95 but displaced above or below the plane of the pump rotor.

Fluid enters the pump cavity 92 through an aperture 97 defined by, for example, a cover layer (not shown) adhered to the pump body 94. Fluid exits the pump cavity 92 through an outlet 98 defined in the pump body 94.

In contrast with, for example, rotary gear pumps or rotary lobe pumps, centrifugal pumps according to the present invention are generally not considered "positive displacement" pumps.

Linear-Actuated Pump Embodiments

Figure 8:
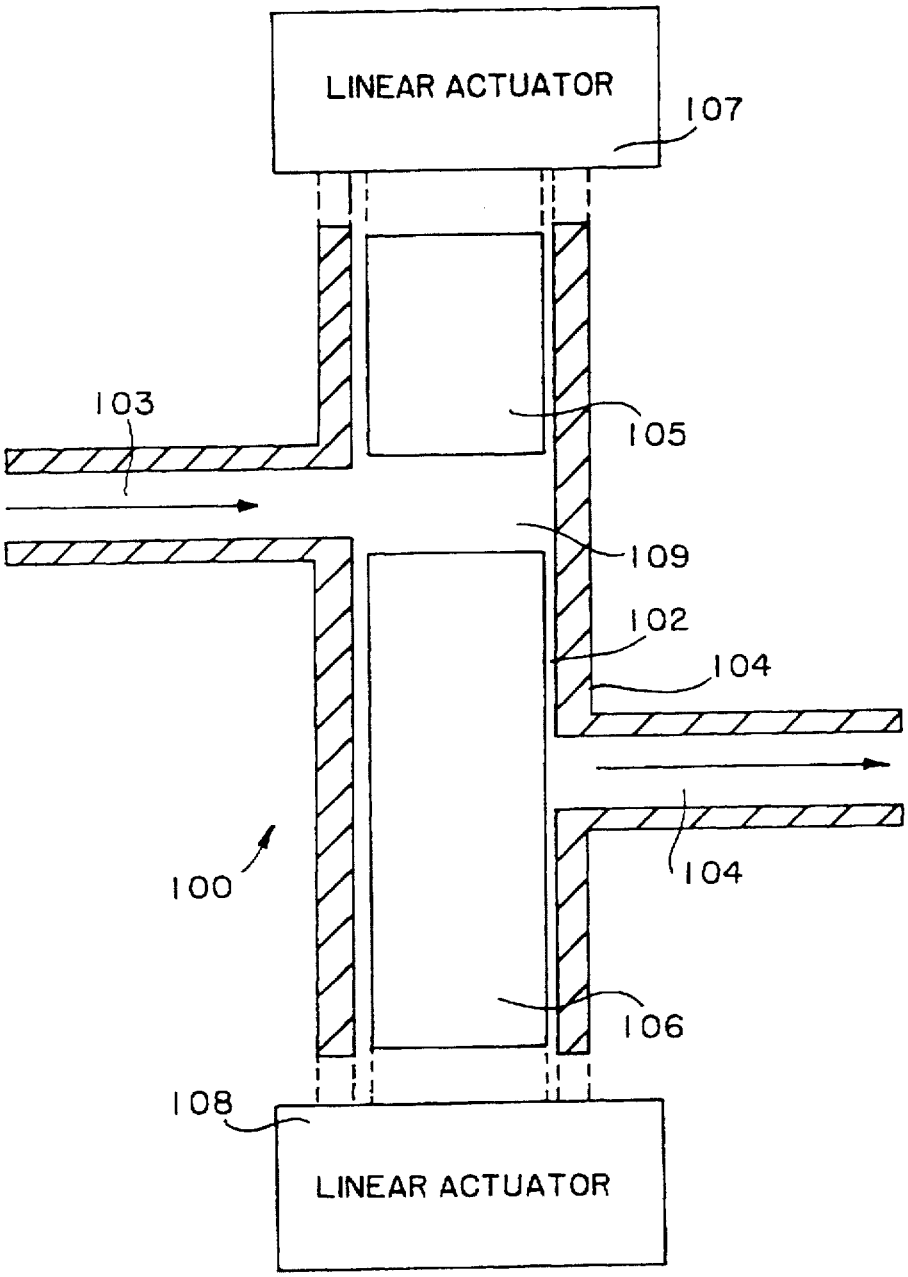
FIG. 8 is a schematic plan view of a representative dual-piston linearly actuated pump embodiment according to the present invention.

A first representative embodiment of a linear-actuated miniature pump according to the present invention is shown in FIG. 8, depicting a two-piston pump 100 wherein each piston is actuated by a separate linear actuator (preferably a "variable-reluctance" type). The pump 100 comprises a pump cavity 102 defined by a pump body 104 adhered to a rigid substrate. Communicating with the pump cavity 102 are an inlet port 103 and an outlet port 104 also defined by the pump body. Situated inside the pump cavity 102 are a first piston 105 and a second piston 106. The first and second pistons can be made, using LIGA methods, from a ferromagnetic material responsive to a magnetic field. Each piston 105, 106 extends into a corresponding "actuator" region 107, 108, respectively, of the pump cavity surrounded by actuator "coils" embedded in the pump body. The actuator coils can be made using LIGA methods in the same manner as described above in section 2.

The first and second pistons 105, 106 are actuated in a periodic, coordinated sequence comprising multiple "cycles." In each cycle, the first piston 105 "pushes" while the second piston 106 "pulls", then the first piston 105 "pulls" while the second piston 106 "pushes". This cyclical operation changes the volume of region 109 which, in cooperation with the alternating positive and negative pressure changes caused by movement of the pistons 105 and 106, effects a pumping operation. Completion of each such cycle results in the delivery of a volume 109 of fluid, aspirated into the pump cavity 102 from the inlet port 103 to the outlet port 104.

To ensure sufficiently tight clearance between the pistons and the interior walls of the pump cavity, the pistons can be produced on a separate substrate using sacrificial layer LIGA methods. After removal from the separate substrate, the pistons are assembled in the pump cavity, after which the pump cavity is closed using a cover plate or the like as discussed above. A suitably tight clearance ensures that the pump is "positive displacement."

Figure 9:
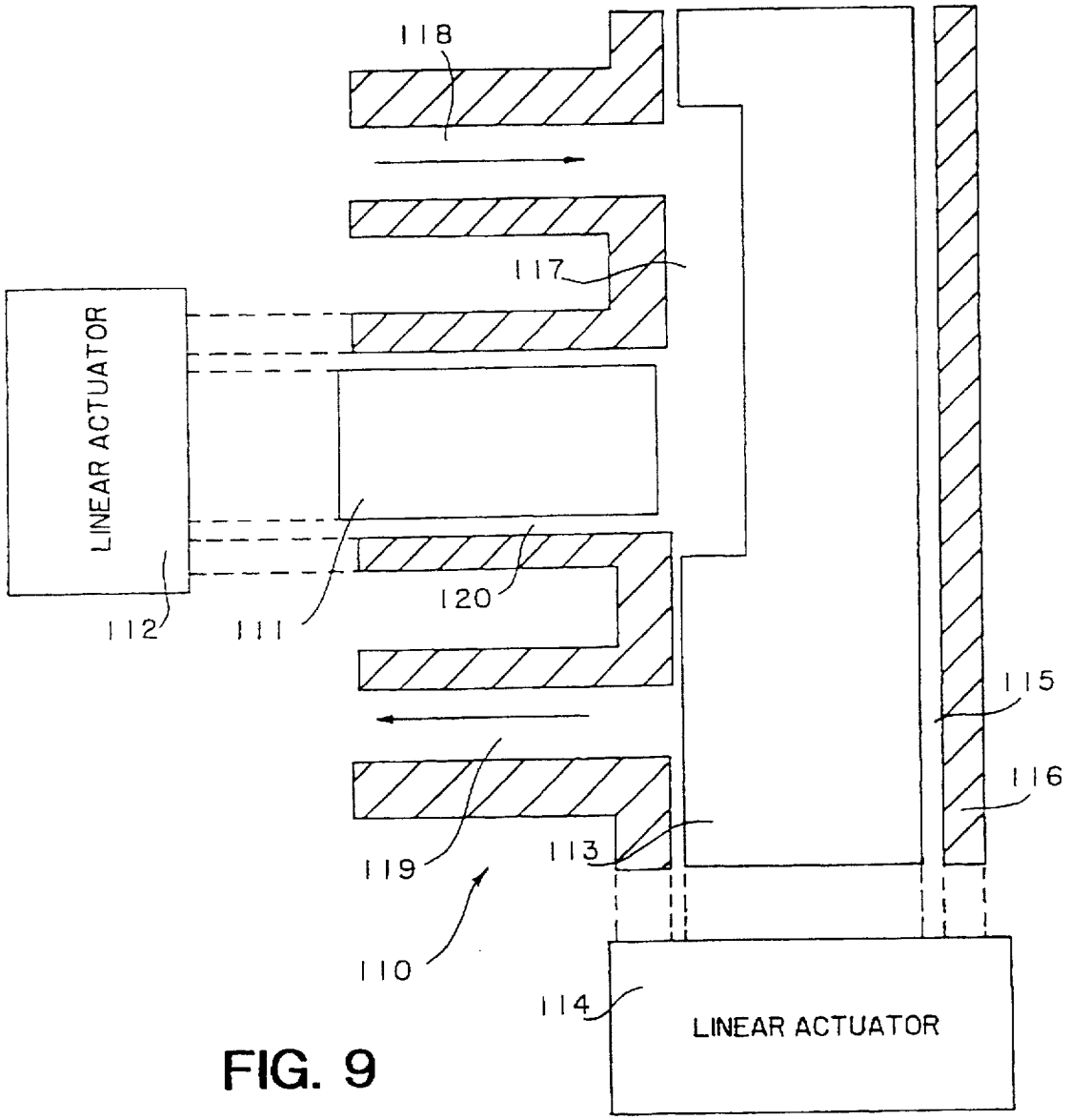
FIG. 9 is a schematic plan view of an alternative linearly actuated pump embodiment according to the present invention having a single piston and a spool valve.

A second representative embodiment of a linear actuated pump according to the present invention is shown in FIG. 9, depicting a pump 110 comprising a piston 111 actuated by a first linear actuator 112 and a spool valve (piston) 113 actuated by a second linear actuator 114. The spool valve 113 is situated in a pump cavity 115 defined by a pump body 116 formed on a rigid substrate, and defines a channel 117 for routing fluid. An inlet port 118 and outlet port 119, also defined by the pump body 116, communicate with the pump cavity 115. Also communicating with the pump cavity 115 is a side cavity 120 defined by the pump body 116 in which is situated the piston 111.

Operation of the pump of FIG. 9 is cyclical. At the beginning of a cycle, wherein the piston 111 and spool valve 113 are situated as shown in FIG. 9, the piston 111 is moved, as urged by the first actuator 112, in a manner urging intake of fluid from the inlet port 118, through the channel 117 on the spool valve 113, and into the side cavity 120. Then, the spool valve 113 shifts, as urged by the second actuator 114, so as to allow passage of fluid from the side cavity 120 to the outlet port 119; such passage of fluid is effected by movement of the piston 111, as urged by the first actuator 112, so as to expel the fluid from the side cavity 120 via the channel 117. Next, the spool valve 113 shifts again, as urged by the second actuator 114, to allow fluid passage from the inlet port 118 to the side cavity 120 via the channel 117, thus beginning another cycle.

It is to be understood that the spool valve in the miniature pump embodiment shown in FIG. 9 can be replaced with a rotary valve that is rotatably actuated by any of various means as discussed above.

It will also be appreciated that the spool valve embodiments described above can be made without a piston to permit the spool valve to be used for valving purposes.

Covering the Pump Cavity

As shown generally in FIG. 3B, the pump cavity can be isolated from the external environment by attaching a cover plate 64 over the pump cavity 52 to the pump body 54. Sealing the cover plate to the pump body can be performed by any of various methods such as by solvent bonding or eutectic (heat) bonding of the cover plate to the pump body, or clamping a cover plate to the pump body with an elastomeric seal interposed between the cover plate and the pump body. Alternatively, if the cover plate is inherently capable of sealing to the pump body with application of a clamping force (such as a cover plate made from PMMA), it is possible to attach a cover plate to the pump body by clamping without an elastomeric seal.

Flow Sensors

The present invention is also extended to flow sensors. In a representative flow sensor according to the present invention, a toothed or vaned rotor is rotatably mounted in a cavity in a manner not unlike that described above for a centrifugal pump. For example, referring to FIG. 7, if fluid entered the pump cavity 92 through the port labeled 98 (i.e., in a direction opposite to the arrow shown in said port, and exited through the port labeled 97, the rotor 95 would be caused to rotate in response to passage of fluid through the pump cavity.

Sensing of rotation of the rotor can be performed optoelectronically, such as by placing a light-emitting diode (LED) and a photo-transistor on opposing sides of the pump cavity such that light passing from the LED to the photo-transistor is interrupted each time a vane of the rotor 95 passes between the LED and the photo-transistor (not shown). Alternatively, the rotor can be configured as a magnetic dipole magnetically coupled to a magnetic field-sensing transducer located outside the pump cavity; as the rotor rotates, its rotation is magnetically sensed by the transducer and electronically converted to, for example, rpm data. Capacitative coupling, rather than magnetic coupling described above, can also be used between the rotor and a suitable capacitance-sensing transducer to sense the rotation of the rotor.

Fluid Motors

It will be appreciated that a rotor mounted inside a pump cavity as described above can also be utilized as a hydraulic motor. Referring again to the embodiment shown in FIG. 7 used as described above as a flow sensor, it will be appreciated that fluid passing through the pump cavity from the port labeled 98 to the port labeled 97 will urge rotation of the rotor 95. The energy of the rotating rotor 95 can be utilized to perform work. For example, the rotor 95 can be magnetically or capacitively coupled to an extraneous rotor (not shown) that, as the rotor 95 urges the extraneous rotor to rotate, generates an electrical current. In another representative embodiment (not shown), the rotor 95 can be mechanically linked to another rotor ("driven rotor") by one or more gears, wherein the driven rotor can be used to perform work on a fluid, such as by pumping the fluid.

Representative Uses

Miniature pumps according to the present invention can be used for a variety of uses, and the following is not to be construed as limiting in any way with respect to the variety of possible uses.

A first arena in which the miniature pumps can be used is in biomedical applications. Representative biomedical applications include, but are not limited to: (a) an implantable device comprising a reservoir of a drug or diagnostic agent capable of actively infusing the drug or agent from the reservoir into a subject's body; (b) withdrawal of a microscopic amount of fluid from a subject's body or from an environment external to the body for analysis; (c) flow-injection analysis of a medicament administered to a subject or of natural movement of a fluid in a subject's body; (d) microchemical instrumentation that can be used in vivo or in vitro, such as instrumentation utilizing microsensors; and (e) sequence analysis and/or synthesis of polypeptides or nucleic acids.

Another field in which miniature pumps according to the present invention have particular utility is in ink-jet printing and similar uses in which minute quantities of fluid must be accurately delivered to a point of use.

Yet another field is in cooling of semiconductor devices, wherein a conventional semiconductor device, such as a high-density integrated circuit or microprocessor, is provided with an on-board fluidic circulation system including a heat exchanger and at least one miniature pump according to the present invention for circulating fluid coolant from the circuit to the heat exchanger and back again. Such cooling would be of particular value in, for example, laser diodes.

When used with most types of miniature pumps according to the present invention, fluids are preferably suitably filtered to remove particulate material that could cause a moving part of the miniature pump to jam. Such filtration can be readily performed using a commercially available sub-micron filter that is compatible with the fluid.

Whereas the invention has been described in connection with various preferred and alternative embodiments, it will be understood that the invention is not limited to those embodiments. On the contrary, the present invention is intended to encompass all alternatives, modifications, and equivalents as may be included within the spirit and scope of the invention as defined by the appended claims.

We claim:

1. A microfabricated, remotely actuated fluid pump comprising:

a cavity defined in a body, said cavity being defined by a process including exposing a material to radiation through an exposure mask;

a movable member fabricated by a LIGA process, the movable member having a maximum dimension less than 5 centimeters, the movable member being disposed within the cavity;

means for sealing the cavity to define a pump chamber having the movable member contained therein, the pump chamber defining an inlet and an outlet; and a drive member disposed outside the pump chamber and coupled to the movable member therein to remotely actuate same;

wherein the LIGA-fabricated movable member and the cavity cooperate to (a) define a sufficiently small clearance therebetween to achieve effective pumping action while (b) presenting a sufficiently low-friction fit to enable said remote actuation.

2. The pump of claim 1 in which the actuator includes a coil, said coil comprising a plurality of turns, each turn including a patterned metal line segment lying in a first plane, said segment being covered, except at its termini, with an insulating film, each turn further comprising first and second metal members, one extending from each terminal of said segment in second planes each orthogonal to the first.

3. The pump of claim 1 in which said actuator comprises lithographically-patterned metal on an insulating member.

4. The pump of claim 1 in which said actuator comprises wire coiled around a LIGA-fabricated form.

5. The pump of claim 1 in which said actuator is a variable-reluctance actuator.

6. The pump of claim 1 in which the movable member comprises ferromagnetic material.

7. The pump of claim 1 in which said movable member is formed by a sacrificial LIGA process, and thereafter inserted into said cavity.

8. The pump of claim 1 wherein said actuator is an electrostatic actuator.

9. The pump of claim 1 wherein the movable member has a minimum dimension of between 50 micrometers and 10,000 micrometers.

10. The pump of claim 1 wherein the cavity is defined by a LIGA process.

11. A plurality of pumps according to claim 1 fabricated on a common substrate.

12. The pump of claim 1 wherein the movable member has a maximum dimension less than 0.5 centimeters.

13. The pump of claim 1 wherein the movable member has a maximum dimension less than 0.05 centimeters.

14. The pump of claim 1 wherein the movable member has a maximum dimension less than 0.005 centimeters.

15. A pump according to claim 1 including two movable members and two linear actuators, at least one of said movable members being a piston.

16. The pump of claim 15 in which each of the actuators comprises a metal coil formed by a LIGA process.

17. The pump of claim 15 in which each actuator includes a coil, said coil comprising a plurality of turns, each turn including a patterned metal line segment lying in a first plane, said segment being covered, except at its termini, with an insulating film, each turn further comprising first and second metal members, one extending from each terminal of said segment in second planes each orthogonal to the first.

18. The pump of claim 15 in which each actuator comprises lithographically-patterned metal on an insulating member.

19. The pump of claim 15 in which each actuator comprises wire coiled around a LIGA-fabricated form.

20. The pump of claim 15 in which each actuator is a variable-reluctance actuator.

21. The pump of claim 15 in which each of the movable members is a piston comprised of a ferromagnetic material.

22. The pump of claim 15 in which each of said members is a piston formed by a sacrificial LIGA process, and thereafter inserted into said cavity.

23. The pump of claim 15 which further includes a valve defined, at least in part, by one of said movable members.

24. The pump of claim 15 wherein each actuator is an electrostatic actuator.

25. The pump of claim 15 wherein the members serve both as inlet and outlet valves, and serve to define a positive displacement chamber.

26. The pump of claim 15 wherein one of said movable members serves as a pumping element and the other of said members serves as a valving element.

* * * * *